US009556637B1

(12) United States Patent
Martins et al.

(10) Patent No.: US 9,556,637 B1
(45) Date of Patent: Jan. 31, 2017

(54) POST GUARD SYSTEM

(71) Applicants: Alvaro Martins, Burlington (CA); Luis Ruivo, Montreal (CA)

(72) Inventors: Alvaro Martins, Burlington (CA); Luis Ruivo, Montreal (CA)

( * ) Notice: Subject to any disclaimer, the term of this patent is extended or adjusted under 35 U.S.C. 154(b) by 0 days.

(21) Appl. No.: 15/150,529

(22) Filed: May 10, 2016

Related U.S. Application Data

(60) Provisional application No. 62/299,627, filed on Feb. 25, 2016.

(51) Int. Cl.

| | |
|---|---|
| ***E04H 17/00*** | (2006.01) |
| ***E04H 12/22*** | (2006.01) |
| ***E01F 15/14*** | (2006.01) |
| ***E04G 21/24*** | (2006.01) |

(52) U.S. Cl.
CPC ..... *E04H 12/2292* (2013.01); *E01F 15/141* (2013.01); *E04G 21/24* (2013.01)

(58) Field of Classification Search
CPC ..... E04H 12/2292; E01F 15/141; E04G 21/24
USPC ..... 256/1, 19
See application file for complete search history.

(56) References Cited

U.S. PATENT DOCUMENTS 3,615,110 A * 10/1971 Fugate ..... E04B 1/2608 256/59
4,644,713 A * 2/1987 Lehman ..... E04H 12/2215 52/165
5,203,817 A * 4/1993 Klumpjan ..... E04H 12/2276 256/19
5,622,356 A * 4/1997 Duggan ..... E04H 12/2292 256/1
5,771,646 A * 6/1998 DeSouza ..... E04F 11/1812 248/300
6,173,945 B1 * 1/2001 Lindsey ..... E04H 17/1413 256/21
6,176,062 B1 * 1/2001 Fayle ..... E01F 15/0469 405/216
6,886,296 B1 * 5/2005 John ..... E04H 12/2292 248/519
2005/0271467 A1 * 12/2005 Ong ..... E02D 5/08 403/359.1
2006/0038163 A1 * 2/2006 Ricci ..... E04H 12/2292 256/1
2008/0128672 A1 * 6/2008 Van Fleet ..... E04H 17/20 256/65.02
2014/0054428 A1 * 2/2014 Walker ..... E04F 11/1812 248/218.4

* cited by examiner

*Primary Examiner* — Beth Stephan

(57) ABSTRACT

A post guard system, comprising a guard sleeve attached to a base portion of a fence type post, the guard sleeve composed of a front panel with a front right lateral edge, a front left lateral edge, a right side panel extending at ninety degrees from the front right lateral edge and a left side panel extending at ninety degrees from the front left lateral edge. The front panel dimensioned to cover fully the width of a front or back face of the fence type post at the bottom portion, the front right lateral edge and the front left lateral edge each having a rounded surface that cover an edge of the fence type post at the bottom portion and the right side panel. The left side panel each dimensioned to cover approximately half the width of a side face of the fence type post at the bottom portion.

13 Claims, 3 Drawing Sheets

POST GUARD SYSTEM

BACKGROUND OF THE INVENTION

This invention relates generally to post for fences and other exterior objects needing a fence type post and, more particularly, to a durable sleeve for covering the base portion of a less durable post element such as a fence type post made of metal, vinyl or wood.

A typical fence consists of elements such as pickets, rails and posts made of varying materials such as metal, vinyl and wood and which are quite smoothly finished in order to present a pleasing appearance. The fence elements are generally painted or treated further to improve their appearance and also to protect them from weathering and rotting from the effects of rain, sunshine, wind, fungus and other conditions. Similarly, mail boxes or street signs often include a fence type post element.

One portion of the fence type post element that is particularly vulnerable is the base portion of the fence type post element. This is irrespective of the material from which the fence type post element is fabricated or of the application of any protective coatings that have been applied to the fence type post element. The base portion of the fence type post element has clearly become the most vulnerable component of a fence as a result of the advent of powered weed and grass trimmers.

The powered weed and grass trimmers has made the tedious task of trimming weeds and grass much easier. Powered trimmers spin a hard nylon cord at high speeds to cut grass and weeds and have all but replaced the use of long-handled scissors. A powered trimmer may spin its nylon cord at high speeds anywhere between 7500 RPMs and 11000 RPMs. Moreover, some powered trimmers use a steel line rather than a nylon cord for even greater power and efficiency.

However, the power and efficiency of powered trimmers comes at a cost when it comes to trimming grass and weeds along and surrounding fence type post element. A trimmer's spinning nylon cord or steel line can cause extensive damage to the base portion of a fence type post element as it trims the area surrounding each fence type post element. The nylon cord or steel line hitting up against a fence type post will eat away at the fence type post's pressure treating, paint or stain eventually leaving the fence type post without any of its original protective coatings. Moreover, even costlier fence type post elements fabricated from durable materials, such as steel, will scratch and deteriorate over time from continued exposure to the effects of a powered trimmer. As a result, irrespective of how durable a fence type post element is when initially installed, the base portion of that fence type post element may eventually deteriorate and become fully exposed to surrounding environmental elements as a result of prolonged exposure to the effects of a power trimmer.

Moreover, a related problem has to do with damage done to the nylon cord or steel line of the powered trimmer. The nylon cords and steel lines of a powered trimmer are prone to damage as a result of their hitting against and wrapping around the right angles of a square or rectangular shaped fence type post element at the high speeds of rotation used during normal operation.

Thus there is a need for a durable and inexpensive fence element which also presents a pleasing appearance and which may be easily installed on a new or existing fence type post elements in order to protection to both the base portion of a fence type post element as well as the nylon cord or steel line of a powered trimmer.

SUMMARY OF THE INVENTION

Therefore, the object of this invention is to provide for fence posts or other fence type post elements that are resistant to the damages caused by modern powered weed and grass trimmers and other lawn equipment and thereby prolong the life of your fences, sign posts, decks, and other landscape structures.

Another object of this invention to provide protection for the nylon cord or steel line of a powered weed and grass trimmer operating in the adjacent to and surrounding fence type posts.

A more specific object of the invention is to provide a post guard system, comprising: a guard sleeve attached to a base portion of a fence type post; the guard sleeve composed of a front panel with a front right lateral edge and a front left lateral edge, a right side panel extending at ninety degrees from the front right lateral edge and a left side panel extending at ninety degrees from the front left lateral edge; the front panel dimensioned to cover fully the width of a front or back face of the fence type post at the bottom portion; the front right lateral edge and the front left lateral edge each having a rounded surface that cover an edge of the fence type post at the bottom portion; and the right side panel and the left side panel each dimensioned to cover approximately half the width of a side face of the fence type post at the bottom portion.

In another more specific object of the invention is to provide a post guard system, comprising: a guard sleeve attached to a base portion of a fence type post or other post element; the guard sleeve composed of a front panel with a front right lateral edge and a front left lateral edge, a right lip extending from the front right lateral edge and a left side lip extending from the front left lateral edge; the front panel dimensioned to cover fully the width of a front or back face of the fence type post at the bottom portion; and the front right lateral edge and the front left lateral edge each having a rounded surface that cover an edge of the fence type post at the bottom portion.

BRIEF DESCRIPTION OF THE DRAWINGS

This disclosure is further described in the detailed description that follows, with reference to the drawings, in which.

DETAILED DESCRIPTION

An exemplary embodiment of a post guard system is disclosed. As required, detailed embodiments of the present invention are disclosed herein; however, it is to be understood that the disclosed embodiments are merely exemplary of the invention that may be embodied in various and alternative forms. The figures are not necessarily to scale and some features may be exaggerated or minimized to show details of particular components. Therefore, the structural and functional details disclosed herein are not to be interpreted as limiting, but merely as a representative basis for teaching one skilled in the art to variously employ the present invention.

Figure 1A:
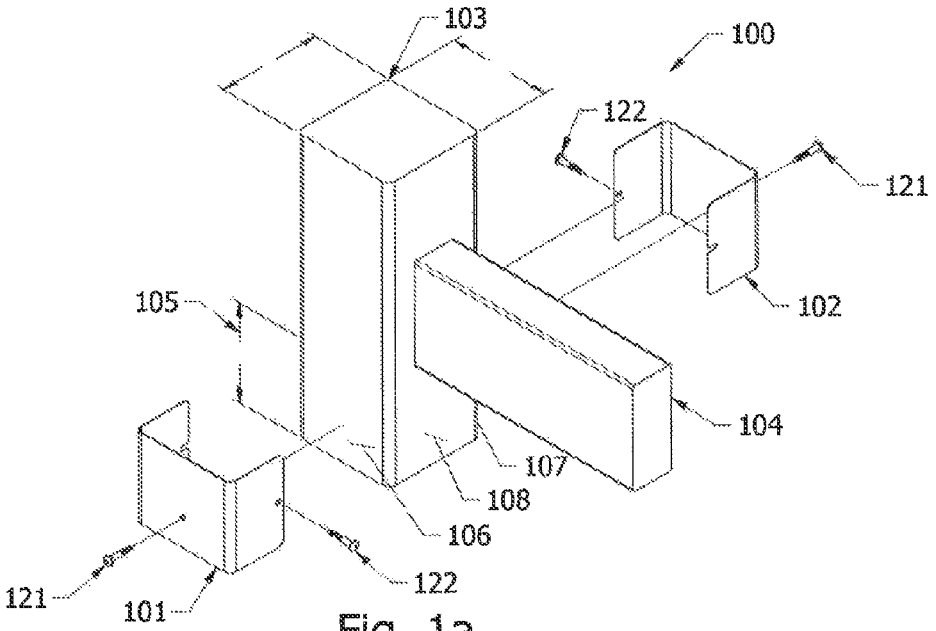
FIG. 1A is a perspective view of a first embodiment of the post guard system as implemented on a square fence type post element.

In FIG. 1A, a perspective view of a first embodiment of the fence type post guard system as implemented on a square fence type post element is shown. As shown in FIG. 1A, the fence type post guard system 100 in this first embodiment is comprised of a first guard sleeve 101 and a second guard sleeve 102, each of which are shaped and dimensioned to be congruent with a base portion 105 of a square fence type post element 103. In this first embodiment, the base portion 105 of the fence type post 103 is any portion of that area below and up the bottom of a rail 104 connected to the fence type post 103.

The first guard sleeve 101 is positioned to fully cover the width of a front face 106 of the bottom portion 105 and to partially cover the width of the side faces 108 of the bottom portion 105 adjoining that front face 106. Similarly, the second guard sleeve 102 is positioned to fully cover a back face 107 of the bottom portion 105 directly opposite the front face 106 and to partially cover those side faces 108 of the bottom portion adjoining that back face 107. The first and second guard sleeves 101, 102 are dimensioned such that when positioned against the front and back faces 106, 107 of the bottom portion 105, respectively, the width of the side faces 108 of the bottom portion 105 are also fully covered by the guard sleeves 101, 102.

Figure 1B:
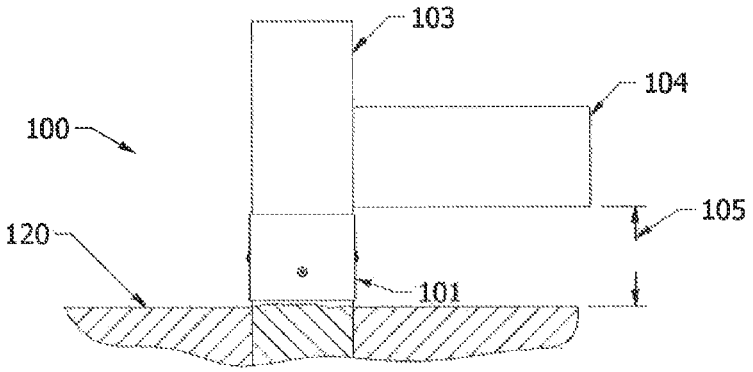
FIG. 1B is a frontal view showing the placement of the first embodiment of the post guard system on a square fence type post element.

In FIG. 1B, a frontal view showing the placement of the first embodiment of the fence type post guard system on a square fence type post element is shown. As discussed above, the first and second guard sleeves 101, 102 are positioned and dimensioned to cover any portion of area below and up the bottom of a rail 104 that is inserted into the fence type post 103. As shown in FIG. 1B, the first and second guard sleeves 101, 102 are positioned and dimensioned to cover the bottom portion 105 of the fence type post 103 defined in-between the top surface of the ground 120 where the fence type post is set and the bottom of the rail 104 connected to that fence type post 103. Specifically, the first and second guard sleeves 101, 102 are positioned to generally align their centers with the path of the nylon cord or steel line of a powered weed and grass trimmer operating near the fence type post 103. Moreover, a first and/or second guard sleeve 101, 102 may be stacked such that they also provide coverage of the fence type post below the top surface of the ground 120 where the fence type post is set.

Figure 1C:
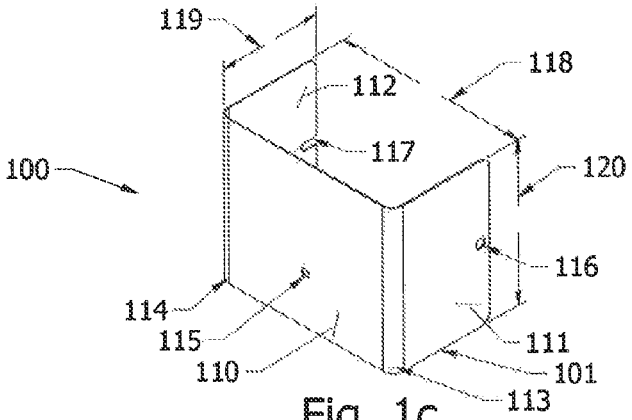
FIG. 1C is a perspective view of the protective sleeve component of the first embodiment of the post guard system.

In FIG. 1C, a perspective view of the guard sleeve component of the first embodiment of the fence type post guard system is shown. As shown in FIG. 1C, a guard sleeve is comprised of a front panel 110 with a front right lateral edge 113 and front left lateral edge 114, a right side panel 111 attached to and extending at ninety degree from the front right lateral edge 113 and a left side panel 112 attached to and extending at ninety degrees from the front left lateral edge 114. The front panel 110 includes a screw hole 115 position near the center of the front panel 110. The right side panel 111 includes a screw hole 116 positioned near the center of a right wing lateral edge that is opposite the front right lateral edged 113. The left side panel 112 includes a screw cut-out 117 on a left wing lateral edge that is opposite the front left lateral edged 114, the cut-out 117 positioned such that it aligns with the screw hole 116 on the right side panel 111.

The front left lateral edge 113 and the front right lateral edge 114 are each purposely rounded to minimize the damage done to nylon cords and steel lines that come into contact with these lateral edges 113, 114 at the high rotation speeds provided by powered trimmers.

As discussed above, the width 118 of the front panel 110 must be approximately equal to the width of the front or back face of the bottom portion 105 of the fence type post 103. The width 119 of the left and right side panels 111, 112 are approximately a little greater than half the width of the side faces of the bottom portion 105 of the fence type post 103. As also discussed above, the height 120 of the front and back guard sleeves is such that is covers a significant portion of the bottom portion 105 of the fence type post 103. As one of reasonable skill in the art will understand, the dimensions of the front and back guard sleeves 101, 102 may be modified to accommodate fence type posts 103 of the varying shapes and sizes.

Returning to FIG. 1A, the front faces 110 of the first and second guard sleeves 101, 102 are each affixed to opposite front and back faces of the fence type post 103 using screws 121 that fit through the screw hole 115 on the front face 110 of each guard sleeve 101, 102.

Similarly, the side panels of the first and second guard sleeves 101, 102 are each affixed to opposite faces of the fence type post 103 using screws 122 that fits through the screw hole 116 and the screw cut-out 117 on the side panels 111, 112 of each guard sleeve 101, 102. The screw-cut puts 117 are designed to allow for expansion and contraction of the fence type post 103.

Figure 2A:
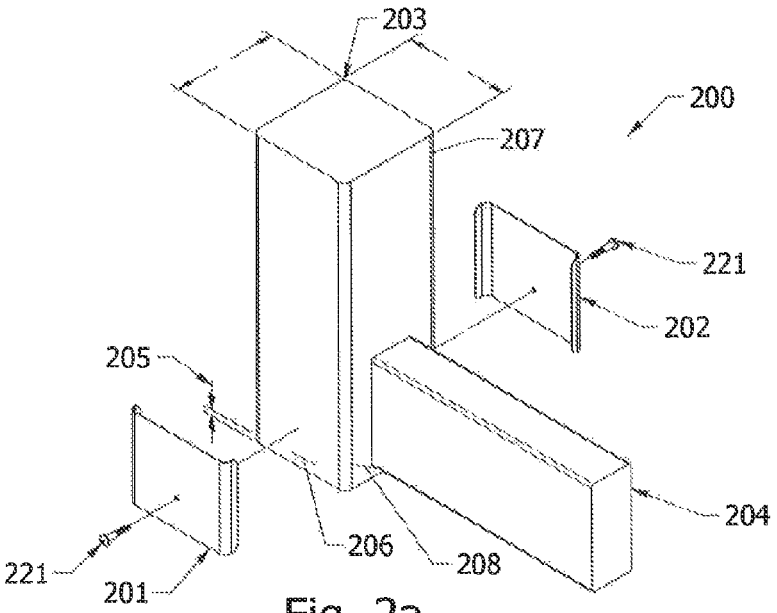
FIG. 2A is a perspective view of a second embodiment of the fence type post guard system as implemented on a square post element.

In FIG. 2A, a perspective view of a second embodiment of the fence type post guard system as implemented on a square fence type post element is shown. As shown in FIG. 2A, the fence type post guard system 200 in this second embodiment is comprised of a first guard sleeve 201 and a second guard sleeve 202, each of which are shaped and dimensioned to be congruent with a base portion 205 of a square fence type post element 203. In this second embodiment, the base portion 205 of the fence type post 203 is any portion of that any area of the fence type post 203 adjacent to a rail 204 connected to the fence type post 203.

The first guard sleeve 201 is positioned to fully cover the width of a front face 206 of the bottom portion 205 and the second guard sleeve 202 is positioned to fully cover a back face 207 of the bottom portion 305 directly opposite the front face 206. In this second embodiment, unlike the first embodiment, the first and second guard sleeves 201, 202 do not partially cover the side faces 298 of the fence type post 203 as the rail 204 in this embodiment is positioned directly adjacent to the first and second guard sleeves 201, 202.

Figure 2B:
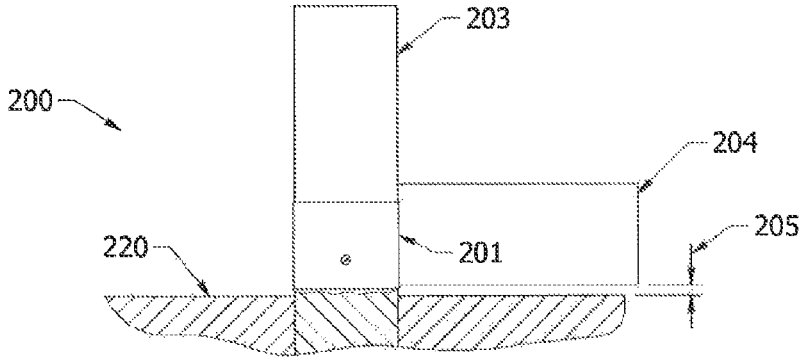
FIG. 2B is a frontal view showing the placement of the second embodiment of the fence type post guard system on a square post element.

In FIG. 2B, a frontal view showing the placement of the second embodiment of the fence type post guard system on a square fence type post element is shown. As shown in FIG. 2B, the first and second guard sleeves 201, 202 are positioned and dimensioned to cover any portion of the bottom portion 205 adjacent to the post 204 inserted into the fence type post 203 and above the top surface of the ground 220 where the fence type post 203 is set. Specifically, the first and second guard sleeves 201, 202 are positioned to generally align their centers with the path of the nylon cord or steel line of a powered weed and grass trimmer operating near the fence type post 203. Moreover, a first and/or second guard sleeve 201, 202 may be stacked such that they also provide coverage of the fence type post below the top surface of the ground 120 where the fence type post is set.

Figure 2C:
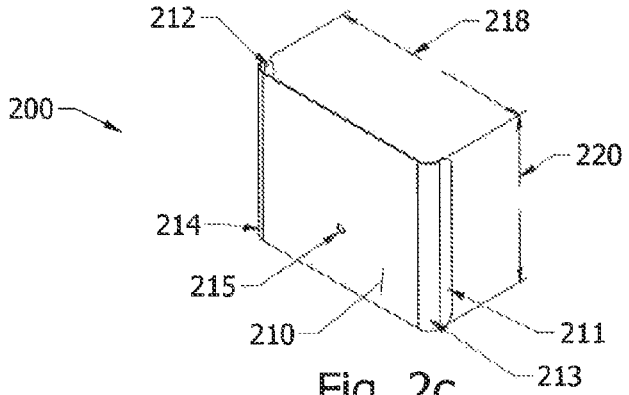
FIG. 2C is a perspective view of the protective sleeve component of the second embodiment of the post guard system.

In FIG. 2C, a perspective view of the guard sleeve component of the second embodiment of the fence type post guard system is shown. As shown in FIG. 2C, a guard sleeve is comprised of a front panel 210 with a front right lateral edge 213 and front left lateral edge 214, a right side lip 211 attached to and extending at ninety degree from the front right lateral edge 213 and a left side lip 212 attached to and extending at ninety degrees from the front left lateral edge 214. The front panel 210 includes a screw hole 215 position near the center of the front panel 210.

The front left lateral edge 213 and the front right lateral edge 214 are each purposely rounded to minimize the damage done to nylon cords and steel lines that come into contact with these lateral edges 213, 214 at the high rotation speeds provided by powered trimmers.

As discussed above, the width 218 of the front panel 210 must be approximately equal to the width of the front or back face of the bottom portion 205 of the fence type post 203. As also discussed above, the height 220 of the front and back guard sleeves is such that is covers a significant portion of the bottom portion 205 of the fence type post 203. As one of reasonable skill in the art will understand, the dimensions of the front and back guard sleeves 201, 202 may be modified to accommodate fence type posts 203 of the varying shapes and sizes.

Returning to FIG. 2A, the front faces 210 of the first and second guard sleeves 201, 102 are each affixed to opposite front and back faces of the fence type post 203 using screws 221 that fit through the screw hole 215 on the front face 210 of each guard sleeve 201, 202.

A person of reasonable skill in the art will understand that the means of attaching the guard sleeves to the fence type posts may be reasonably varied while still remaining within the scope of the present invention including the use of glue or double sided tape rather than screws. Moreover, a person of reasonable skill in the art will understand that using a single guard sleeve on one side of a fence type post rather than two guard sleeves on opposing sides of the fence type post is also within the scope of the present invention.

Figure 3A:
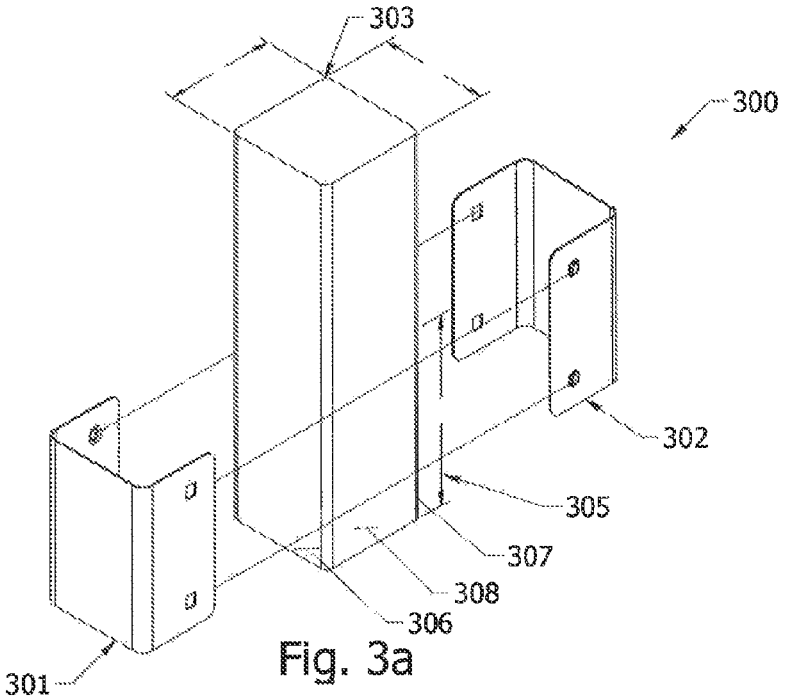
FIG. 3A is a perspective view of a third embodiment of the fence type post guard system as implemented on a square post element.

In FIG. 3A, a perspective view of a third embodiment of the fence type post guard system as implemented on a square fence type post element is shown. As shown in FIG. 3A, the fence type post guard system 300 in this third embodiment is comprised of a first guard sleeve 301 and a second guard sleeve 302, each of which are shaped and dimensioned to be congruent with a base portion 305 of a fence type post element 303. In this third embodiment, the base portion 305 of the fence type post 303 is any portion of that any area of the fence type post 203 above the surface of the ground.

The first guard sleeve 301 is positioned to fully cover the width of a front face 306 of the bottom portion 305 and to partially cover the width of the side faces 308 of the bottom portion 305 adjoining that front face 306. Similarly, the second guard sleeve 302 is positioned to fully cover a back face 307 of the bottom portion 305 directly opposite the front face 306 and to partially cover those side faces 308 of the bottom portion adjoining that back face 307. The first and second guard sleeves 301, 302 are dimensioned such that when positioned against the front and back faces 306, 307 of the bottom portion 305, respectively, the width of the side faces 308 of the bottom portion 305 are also fully covered by the guard sleeves 301, 302.

Figure 3B:
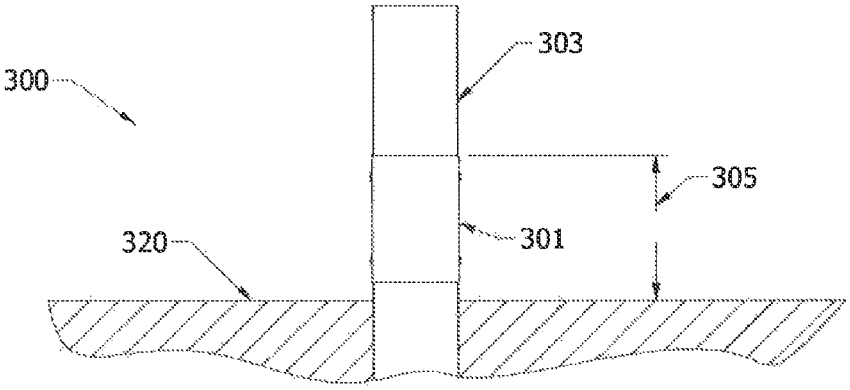
FIG. 3B is a frontal view showing the placement of the third embodiment of the fence type post guard system on a square post element.

In FIG. 3B, a frontal view showing the placement of the third embodiment of the fence type post guard system on a square fence type post element is shown. As shown in FIG. 3B, the first and second guard sleeves 301, 302 are positioned and dimensioned to cover any area of the bottom portion 305 above the top surface 320 of the ground where the fence type post 303 is set. Specifically, the first and second guard sleeves 301, 302 are positioned to generally align their centers with the path of the nylon cord or steel line of a powered weed and grass trimmer operating near the fence type post 303. Moreover, a first and/or second guard sleeve 301, 302 may be stacked such that they also provide coverage of the fence type post below the top surface of the ground 320 where the fence type post 303 is set.

Figure 3C:
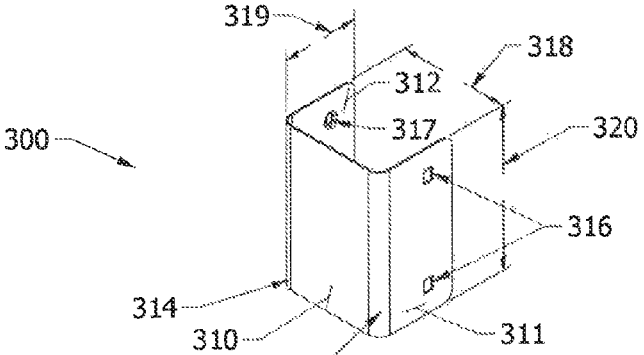
FIG. 3C is a perspective view of the protective sleeve component of the third embodiment of the post guard system.

In FIG. 3C, a perspective view of the guard sleeve component of the third embodiment of the fence type post guard system is shown. As shown in FIG. 3C, a guard sleeve is comprised of a front panel 310 with a front right lateral edge 313 and front left lateral edge 314, a right side panel 311 attached to and extending at ninety degree from the front right lateral edge 313 and a left side panel 312 attached to and extending at ninety degrees from the front left lateral edge 314. The right side panel 311 includes a pairs of receiving holes 316 positioned near the right wing longitudinal edges of the right side panel 311. The left side panel 312 includes a pair of extrusions 317 near the longitudinal edges of the left side panel 312, the pairs extrusions 317 positioned such that to align with the receiving holes 316 on the right side panel 311.

The front left lateral edge 313 and the front right lateral edge 314 are each purposely rounded to minimize the damage done to nylon cords and steel lines that come into contact with these lateral edges 313, 314 at the high rotation speeds provided by powered trimmers.

As discussed above, the width 318 of the front panel 310 must be approximately equal to the width of the front or back face of the bottom portion 305 of the fence type post 303. The width 319 of the left and right side panels 311, 312 are approximately a little greater than half the width of the side faces of the bottom portion 305 of the fence type post 303. As also discussed above, the height 320 of the front and back guard sleeves is such that is covers a significant portion of the bottom portion 305 of the fence type post 303. As one of reasonable skill in the art will understand, the dimensions of the front and back guard sleeves 301, 302 may be modified to accommodate fence type posts 303 of the varying shapes and sizes.

Returning to FIG. 3A, the guard sleeves 301, 302 are secured around the fence type post 303 by positioning each guard sleeve 301, 302 at opposite front and back faces of the fence type post 303 and then bending the left side panel 312 of each of the guard sleeves 301, 302 so as to insert the pairs of extrusions 317 into the corresponding receiving holes 316 on the right side panels.

A person of reasonable skill in the art will understand that the shape of the guard sleeves as well as the number and placement of extrusions and corresponding receiving holes may be varied while still remaining within the scope of the present invention.

In all the above-described preferred embodiments, the guard sleeves are made of from galvanized steel. However, a person of reasonable skill will understand that any other suitable material may be used while still remaining within the scope of the present invention. A suitable material includes any material able to provide sufficient protection from the damages possibly inflicted by a powered trimer.

In all the above-described preferred embodiments, the guard sleeves may be powder paint coated to resemble the fence type post to which they are attached.

What is claimed is:

1. A post guard system, comprising:

a guard sleeve attached to a base portion of a post;

the guard sleeve composed of a front panel with a front right lateral edge and a front left lateral edge, a right side panel extending at ninety degrees from the front right lateral edge and a left side panel extending at ninety degrees from the front left lateral edge;

the front panel dimensioned to cover fully a width of a front or back face of the post at a bottom portion;

the front right lateral edge and the front left lateral edge each having a rounded surface that cover an edge of the post at the bottom portion;

the right side panel and the left side panel each dimensioned to cover approximately half the width of a side face of the post at the bottom portion; and wherein the guard sleeve is attached to the base portion of the post using a first screw positioned through a screw hole in the front panel and a second screw through a screw hole in the right side panel, and wherein the left side panel includes a screw slot extending from a distal edge of the left side panel positioned to align with the screw hole on the right side panel.

2. The post guard system of claim 1 wherein the guard sleeve is attached to the base portion of the post using double stick tape positioned between an inside surface of the front face and an inner surface of the left and right side panels and an outer surface of the post.

3. The post guard system of claim 1 wherein the guard sleeve is made of galvanized steel.

4. The post guard system of claim 1 wherein the guard sleeve is made of hardened plastic.

5. The post guard system of claim 1 wherein an outer surface of the guard sleeve is painted to resemble the post.

6. The post guard system of claim 1 wherein the guard sleeve comprises two guard sleeves each attached to one of a front and a back sides of the post.

7. A post guard system, comprising:

a guard sleeve attached to a base portion of a post;

the guard sleeve composed of a front panel with a front right lateral edge and a front left lateral edge, a right lip extending substantially parallel to the front panel and from the front right lateral edge and a left side lip extending substantially parallel to the front panel and from the front left lateral edge, the right and left lips running the full length of their corresponding lateral edges;

the front panel dimensioned to cover fully a width of a front or back face of the post at a bottom portion; and the front right lateral edge and the front left lateral edge each having a rounded surface that cover an edge of the post at the bottom portion.

8. The post guard system of claim 7 wherein the guard sleeve is attached to the base portion of the post using a first screw positioned through a screw hole in the front panel.

9. The post guard system of claim 7 wherein the guard sleeve is attached to the base portion of the post using double stick tape positioned between an inside surface of the front face and an outer surface of the post.

10. The post guard system of claim 7 wherein the guard sleeve is made of galvanized steel.

11. The post guard system of claim 7 wherein the guard sleeve is made of hardened plastic.

12. The post guard system of claim 7 wherein an outer surface of the guard sleeve is painted to resemble the post.

13. The post guard system of claim 7 the guard sleeve comprises two guard sleeves each attached to one of a front and back side of the post.

* * * * *